US010151277B2

(12) United States Patent
Ohrem et al.

(10) Patent No.: US 10,151,277 B2
(45) Date of Patent: Dec. 11, 2018

(54) HIGH AND LOW PRESSURE EGR WITH A COMMON VALVE HOUSING

(71) Applicant: Hanon Systems, Daejeon (KR)

(72) Inventors: Carsten Ohrem, Bergheim (DE); Peter Diehl, Köln (DE); Stojan Cucuz, Köln (DE)

(73) Assignee: HANON SYSTEMS, Daejoen (KR)

( * ) Notice: Subject to any disclaimer, the term of this patent is extended or adjusted under 35 U.S.C. 154(b) by 317 days.

(21) Appl. No.: 14/877,031

(22) Filed: Oct. 7, 2015

(65) Prior Publication Data

US 2016/0097320 A1 Apr. 7, 2016

(30) Foreign Application Priority Data

Oct. 7, 2014 (DE) ..... 10 2014 114 507
Aug. 28, 2015 (DE) ..... 10 2015 114 356

(51) Int. Cl.

| | |
|---|---|
| ***F02M 26/05*** | (2016.01) |
| ***F02M 26/06*** | (2016.01) |
| ***F02M 26/23*** | (2016.01) |
| ***F02M 26/25*** | (2016.01) |
| ***F02M 26/09*** | (2016.01) |

(52) U.S. Cl.

CPC ..... *F02M 26/05* (2016.02); *F02M 26/06* (2016.02); *F02M 26/09* (2016.02); *F02M 26/23* (2016.02); *F02M 26/25* (2016.02)

(58) Field of Classification Search

CPC ..... F02M 26/05; F02M 26/06; F02M 26/23
See application file for complete search history.

(56) References Cited

U.S. PATENT DOCUMENTS

2010/0043761 A1 2/2010 Joergl et al.
2011/0302918 A1* 12/2011 Vollmer ..... F02M 26/05 60/605.2
2013/0000619 A1 1/2013 Ewen

FOREIGN PATENT DOCUMENTS

KR 20130028332 A 3/2013

* cited by examiner

*Primary Examiner* — Mary A Davis
(74) *Attorney, Agent, or Firm* — Shumaker, Loop & Kendrick, LLP; James D. Miller

(57) ABSTRACT

A device of a system for air ducting of an internal combustion engine in a motor vehicle with a turbocharger arranged between an exhaust gas line and an intake line. The device includes a high pressure flow pathway with a valve branching from the exhaust gas line between the internal combustion engine and a turbine side of the turbocharger, a low pressure flow pathway with a valve branching in the flow direction of the exhaust gas downstream from the turbine side of the turbocharger, and an exhaust gas heat exchanger. A first flow pathway with a valve and a second flow pathway with a valve merge into a mouth region with a third flow pathway. At least one section of the high pressure flow pathway, the low pressure flow pathway, the flow pathways, and the exhaust gas heat exchanger are integrated inside a housing formed as a continuous compact unit.

17 Claims, 6 Drawing Sheets

HIGH AND LOW PRESSURE EGR WITH A COMMON VALVE HOUSING

CROSS-REFERENCE TO RELATED APPLICATION

This patent application claims priority to German Non-Provisional Patent Application Serial No. DE 102014114507.0 filed Oct. 7, 2014 and German Non-Provisional Patent Application Serial No. DE 102015114356.9 filed Aug. 28, 2015. The disclosures of the above patent applications are hereby incorporated herein by reference in their entirety.

FIELD OF THE INVENTION

The invention concerns a device of a system for air ducting of an internal combustion engine in a motor vehicle. The system is configured with a turbocharger arranged between an exhaust gas line for the expansion of the exhaust gas and an intake line for the compression of the intake air. The device has a housing, a high pressure flow pathway branching off from the exhaust gas line between the internal combustion engine and a turbine side of the turbocharger with a valve, a low pressure flow pathway branching off in the flow direction of the exhaust gas downstream from the turbine side of the turbocharger with a valve, a flow pathway branching off in the flow direction of the intake mass air flow upstream from a compressor side of the turbocharger, and an exhaust gas heat exchanger.

BACKGROUND OF THE INVENTION

Systems are known from the prior art for exhaust gas recirculation of internal combustion engines in motor vehicles. In the systems for exhaust gas recirculation of this kind, the fresh air taken in for the internal combustion engine is mixed with cooled or uncooled exhaust gas in order to meet the legal guidelines of the exhaust gas/emission regulations in regard to nitrogen oxides, but also the emission of hydrocarbons, particles, or carbon dioxide, or to lower the fuel consumption. In this process, exhaust gas is removed from the engine's exhaust gas section and after mixing with fresh air it is returned for combustion once more.

In order to control a mass flow of exhaust gas flowing through the turbocharger, that is, the turbine side of the turbocharger, a bypass valve, also known as a "waste gate" is used, and to control the mass flow of intake air flowing through the turbocharger, that is the compressor side of the turbocharger, a divert-air valve known as a blow-off valve or pop-off valve is used.

For a predetermined charge pressure, the bypass valve configured in particular as a flap valve is opened by means of an actuator arranged on the compressor side of the turbocharger, so that at least a portion of the mass flow of exhaust gas is ducted past the turbine of the turbocharger in order to prevent a rise in the number of revolutions of the turbine. The bypass valve is controlled in this case by a control rod of an electric actuator or by a siphon.

The divert-air valve, which is configured in particular as a seat valve and controlled by a pressure difference or electrically, is used so as not to damage the turbocharger upon sudden drop in the power demand for the engine and thus sudden decrease in the mass air flow through the turbocharger.

Various systems are known from the prior art for exhaust gas recirculation, including both Diesel engine and Otto engine systems, while in each case an exhaust gas recirculation is employed in the high pressure region and/or an exhaust gas recirculation is employed in the low pressure region. Furthermore, for exhaust gas recirculation in the low pressure region one distinguishes between a removal of the exhaust gas upstream and downstream from the exhaust gas aftertreatment, such as a catalyst. A system for exhaust gas recirculation can have an exhaust gas heat exchanger, valves usually designed as seat or poppet valves, and bypass sections with bypass valves usually designed as a flap valve or a poppet valve, electrically or siphon operated.

FIG. 1 shows a system 1' for air ducting of an internal combustion engine 3 with arrangements 2*a*', 2*b*' for recirculation of exhaust gas known from the prior art.

The system 1' has an intake line 8 to draw in combustion air for the internal combustion engine 3. Through the intake line 8, fresh air is drawn in from the surroundings through the compressor side of a turbocharger 5 in the flow direction 9. The compressed air is taken through a charge air cooler 10 to the internal combustion engine 3 and distributed among the individual cylinders.

The exhaust gas produced during the combustion is taken away by the exhaust gas line 4 across the turbine side of the turbocharger 5. The turbine side and the compressor side of the turbocharger 5 are mechanically coupled, for example, by a shaft, so that the turbine drives the compressor and thus increases the air throughput or decreases the suction work of the pistons of the internal combustion engine 3. The turbocharger 5 consequently draws the energy for compression of the intake air from the residual exhaust gas pressure. The exhaust gas is taken in the flow direction 7 of the exhaust gas, after passing through the turbine side of the turbocharger 5 and devices 6*a*, 6*b* for aftertreatment of the exhaust gas, to the surroundings.

The exhaust gas line 4 and the intake line 8 are fluidically connected via arrangements 2*a*', 2*b*' for recirculation of exhaust gas, the first arrangement 2*a*' for exhaust gas recirculation operating in the high pressure region and the second arrangements 2*b*' for exhaust gas recirculation operating in the low pressure region. The first arrangement 2*a*' connects the exhaust gas line 4 in the flow direction 7 of the mass flow of exhaust gas upstream from the turbine side of the turbocharger 5 to the intake line 8 in the flow direction 9 of the intake mass air flow downstream from the charge air cooler 10 and thus downstream from the compressor side of the turbocharger 5. The second arrangements 2*b*' connect the exhaust gas line 4 in the flow direction 7 of the mass flow of exhaust gas downstream from the turbine side of the turbocharger 5 to the intake line 8 in the flow direction 9 of the intake mass air flow upstream from the compressor side of the turbocharger 5.

In each case the arrangements 2*a*', 2*b*' are configured by an exhaust gas heat exchanger 11*a*', 11*b*' for exhaust gas cooling and a valve 14*a*', 14*b*' for regulating the quantity and thus the dosage of the recirculated mass flow of exhaust gas.

One of the arrangements 2*b*' for recirculation of exhaust gas in the low pressure region furthermore enables a recirculation of clean exhaust gas, since the exhaust gas is removed in the flow direction 7 downstream from a device 6*a* for aftertreatment of the exhaust gas.

In the systems known to the prior art for exhaust gas recirculation of an internal combustion engine 3 in a motor vehicle one uses for both the exhaust gas recirculation in the high pressure region and for exhaust gas recirculation in the low pressure region exhaust gas heat exchangers 11*a*', 11*b*' and valves 14*a*', 14*b*' with actuators as well as bypasses 12*a*', 12*b*' with bypass valves 13*a*', 13*b*' with actuators. Furthermore, the turbochargers 5 of the traditional systems of exhaust gas recirculation have a "waste gate" valve and a divert-air valve, each with actuators.

Thus, the known systems designed for the six different application options—exhaust gas recirculation in the high pressure region, exhaust gas recirculation in the low pressure region, each time with bypasses as well as turbocharger with "waste gate" valve and divert-air valve—are configured with at least ten different components, that is, each time in addition with the exhaust gas heat exchangers and the bypass valves. The separate configuration of the components results in an increased number of parts, an increased space requirement, a high weight, and increased manufacturing costs and installation costs. Six of the ten components are valves, which are optionally electrically actuated.

SUMMARY OF THE INVENTION

The problem which the invention proposes to solve consists in providing a device for exhaust gas recirculation for a system for air ducting of an internal combustion engine. The device should have a simple and compact design with a minimum number of components with minimal space requirement and a low weight, with at least the same number of application options as in the prior art. Furthermore, the costs of fabrication, maintenance and installation of the device should be minimal.

The problem is solved by the subject matter with the features of the independent patent claims. Modifications are given in the dependent patent claims.

The problem is solved by a device according to the invention of a system for air ducting of an internal combustion engine in a motor vehicle. The system is configured with a turbocharger arranged between an exhaust gas line for the expansion of the exhaust gas and an intake line for the compression of the intake air. The device has a housing, a high pressure flow pathway branching off from the exhaust gas line between the internal combustion engine and a turbine side of the turbocharger with a valve, a low pressure flow pathway branching off in the flow direction of the exhaust gas downstream from the turbine side of the turbocharger with a valve, a flow pathway branching off in the flow direction of the intake mass air flow upstream from a compressor side of the turbocharger and an exhaust gas heat exchanger.

According to the concept of the invention, a first flow pathway with a valve and a second flow pathway with a valve are configured, which emerge into a mouth region with the flow pathway branching off in the flow direction of the intake mass air flow upstream from the compressor side of the turbocharger. In each case at least one section of the high pressure flow pathway, the low pressure flow pathway, and the flow pathways emerging into the mouth region as well as the exhaust gas heat exchanger is integrated inside the housing. Furthermore, the housing is designed as a continuous compact unit.

According to one advantageous embodiment of the invention, the valve of the high pressure flow pathway and/or the valve of the low pressure flow pathway and/or the valves of the first and/or the second flow pathways which emerge into the mouth region are integrated inside the housing.

According to one modification of the invention, the housing is configured as a one-piece component. The one-piece housing is thus also one-part. Alternatively, the housing has a multiple-part configuration and is joined into a cohesive compact unit when the device is assembled.

According to another first alternative embodiment of the invention, the exhaust gas heat exchanger is arranged between the first flow pathway and the second flow pathway, joining the flow pathways. The first flow pathway extends from the valve of the high pressure flow pathway and the second flow pathway from the valve of the low pressure flow pathway up to the mouth region of the flow pathways.

According to a second alternative embodiment of the invention, the exhaust gas heat exchanger is arranged inside the second flow pathway. The high pressure flow pathway and the low pressure flow pathway empty into each other, the first flow pathway and the second flow pathway furthermore each extend from the mouth of the high pressure flow pathway and the low pressure flow pathway up to the mouth region of the flow pathways.

Another advantageous embodiment of the invention consists in that a third flow pathway is configured, which branches off in the flow direction of the intake mass air flow downstream from the compressor side of the turbocharger and from the mouth region, into which also empties the flow pathway branching off in the flow direction of the intake mass air flow upstream from the compressor side of the turbocharger. The flow pathway branching off in the flow direction of the intake mass air flow upstream from the compressor side of the turbocharger shall also be called hereafter the fourth flow pathway.

The third flow pathway and the fourth flow pathway are each configured with a valve, while the third flow pathway with valve and the fourth flow pathway with valve are integrated inside the housing.

The valves of the first, second, third, and fourth flow pathway are preferably configured each time as a flap valve and arranged inside the mouth region, especially at the edge of the mouth region, of the flow pathways.

According to another advantageous embodiment of the invention, the valve of the first flow pathway and the valve of the second flow pathway are configured with a common actuator for simultaneous and joint actuation.

The valves of the first and the second flow pathway are preferably each configured as a three-way valve, especially as a flap valve, and arranged within the mouth region, especially at the edge of the mouth region, of the flow pathways.

According to another advantageous embodiment of the invention, the valve of the high pressure flow pathway and the valve of the low pressure flow pathway are configured with a common actuator for simultaneous and joint actuation.

The valve of the high pressure flow pathway and the valve of the low pressure flow pathway are preferably each configured as a poppet valve with rectilinear movement.

According to a modification of the invention, the valve of the third flow pathway and the valve of the fourth flow pathway are configured with a common actuator for simultaneous and joint actuation.

The valves of the third and the fourth flow pathway are preferably each configured as a three-way valve, especially as a flap valve, and arranged within the mouth region, especially at the edge of the mouth region, of the flow pathways.

According to another preferred embodiment of the invention, the valves of the first, second, third and fourth flow pathway are configured with a common actuator for simultaneous and joint actuation.

The valves of the first, second, third, and fourth flow pathway are advantageously grouped together as a four-way valve, especially as a rotary valve, which is arranged inside the mouth region of the flow pathways.

The housing preferably has channels for ducting a cooling agent for the cooling of components of the device, especially for cooling of the valve of the high pressure flow pathway, the valve of the low pressure flow pathway, or the valves of the first and second flow pathways emptying into the mouth region. For a cooling of the exhaust gas heat exchanger with a cooling agent, the channels integrated in the housing for the ducting of the cooling agent are advantageously connected fluidically to the volume of the exhaust gas heat exchanger which is subjected to the cooling agent.

The problem is also solved by a method according to the invention for operating the device of a system for air ducting of an internal combustion engine in a motor vehicle. The device is operated as needed in one of the following modes:

- removal of exhaust gas from the high pressure region and supplying of the exhaust gas in the low pressure region with cooling of the exhaust gas or
- removal of exhaust gas from the high pressure region and supplying of the exhaust gas in the low pressure region without cooling of the exhaust gas or
- recirculation of exhaust gas in the low pressure region with cooling of the exhaust gas or
- recirculation of exhaust gas in the low pressure region without cooling of the exhaust gas or
- fresh air flow to the exhaust gas side or
- removal of exhaust gas from the high pressure region and the low pressure region and supplying of the exhaust gas in the low pressure region without cooling of the exhaust gas or
- removal of exhaust gas from the high pressure region and the low pressure region and supplying of the exhaust gas in the low pressure region with cooling of the exhaust gas from the high pressure region or
- removal of exhaust gas from the high pressure region and the low pressure region and supplying of the exhaust gas in the low pressure region with cooling of the exhaust gas from the low pressure region.

According to a first alternative embodiment, the device is operated in the mode for

- ducting of the exhaust gas coming from the internal combustion engine in a "waste-gate" function in a bypass around the turbine side of the turbocharger.

According to a second alternative embodiment, the device is operated as needed in one of the following modes:

- recirculation of exhaust gas in the high pressure region with cooling of the exhaust gas or
- recirculation of exhaust gas in the high pressure region without cooling of the exhaust gas or
- ducting of a mass air flow taken in from the surroundings in a bypass around the compressor side of the turbocharger to the internal combustion engine without recirculation of exhaust gas in the form of a divert-air valve.

According to one modification of the invention, the device is operated in the mode for

- ducting of a mass air flow taken in from the surroundings in a bypass around the compressor side of the turbocharger to the internal combustion engine in the form of a divert-air valve and ducting of the exhaust gas coming from the internal combustion engine in a "waste-gate" function in a bypass around the turbine side of the turbocharger.

Summarizing, the compact device according to the invention for the exhaust gas recirculation of an internal combustion engine has various benefits:

- an exhaust gas heat exchanger for exhaust gas at high pressure or low pressure,
- minimal number of parts and therefore minimal design space, minimal weight with minimal costs for fabrication, assembly and maintenance, while the reduced use of material resources is beneficial and a lower weight which also reduces the weight of the motor vehicle and thus the moving mass leads to fuel economy and reduces the emission of carbon dioxide, and
- providing of different operating modes of the exhaust gas recirculation in order to better attune the engine characteristics in terms of the exhaust gas recirculation and to operate the internal combustion engine more efficiently in terms of consumption and with fewer emissions and less output of pollutants.

DESCRIPTION OF THE DRAWINGS

Further details, features and benefits of embodiments of the invention will emerge from the following specification of sample embodiments making reference to the accompanying figures. There are shown:

FIG. 7A, 7B: Actuator for actuation of two valves with a drive and adjustment elements in side view and top view, FIG. 7C: Actuator from FIG. 7B in connection with the valves.

WRITTEN DESCRIPTION OF THE INVENTION

Figure 1:
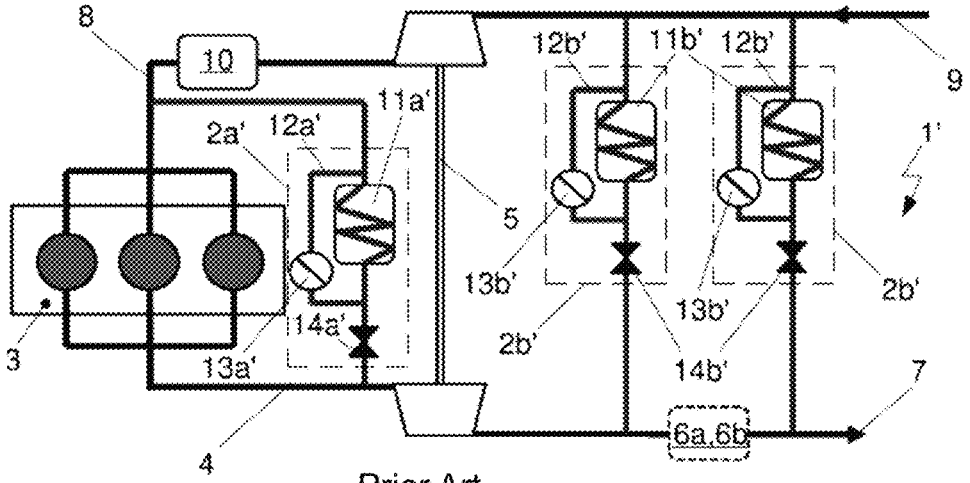
Prior Art Fig. 1
FIG. 1: System for air ducting of an internal combustion engine with arrangements for recirculation of exhaust gas known from the prior art.
Figure 2:
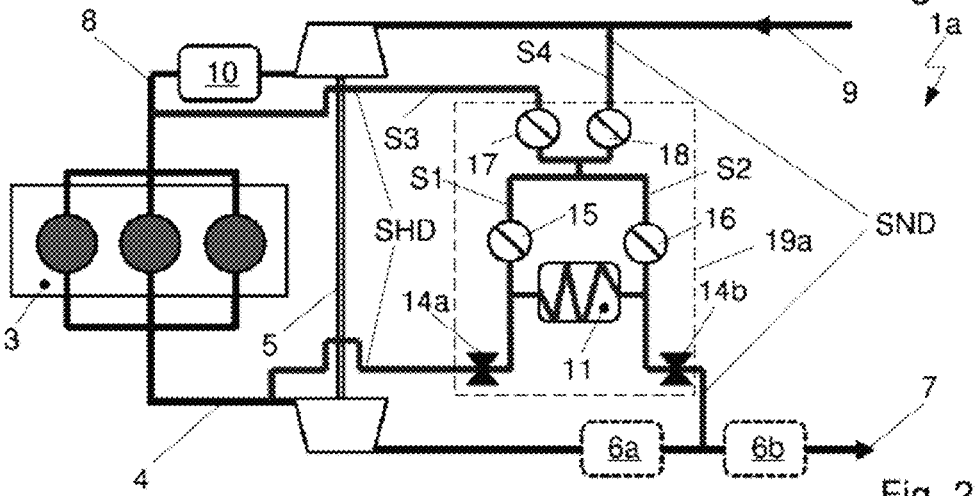
FIGS. 2, 3: System for recirculation of exhaust gas of an internal combustion engine with a device for exhaust gas recirculation at high pressure or low pressure with four flow pathways and valves arranged in the flow pathways, as well as an exhaust gas heat exchanger.
Figure 3:
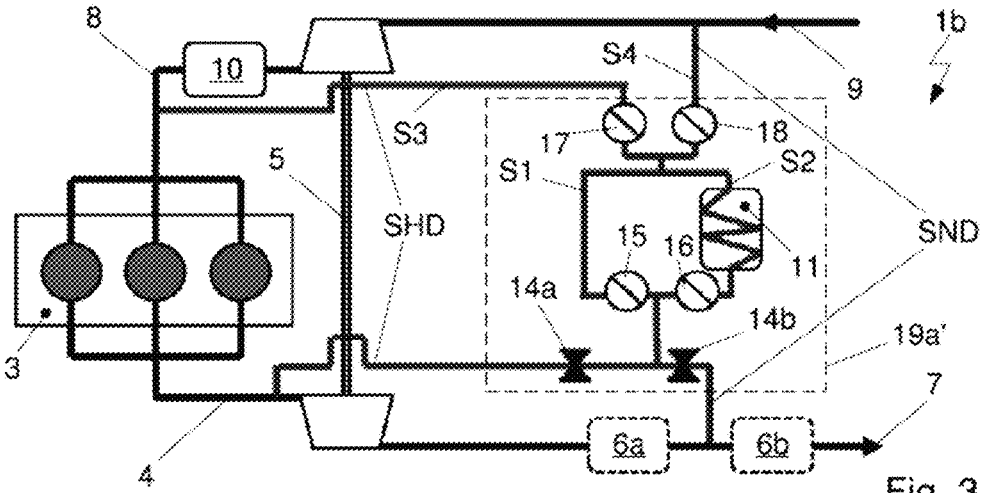

FIGS. 2 and 3 each show a system 1*a*, 1*b* for recirculation of exhaust gas of an internal combustion engine 3 with a device for exhaust gas recirculation 19*a*, 19*a*' at high pressure and/or low pressure with four flow pathways S1, S2, S3, S4 and valves 15, 16, 17, 18 arranged in the flow pathways S1, S2, S3, S4 as well as an exhaust gas heat exchanger 11.

Through the intake line 8, fresh air as well as the exhaust gas is taken in from the surroundings across the compressor side of the turbocharger 5 in the flow direction 9 as combustion air for the internal combustion engine 3. The air, compressed by flowing through the compressor side of the turbocharger 5, is ducted across the charge air cooler 10 to the internal combustion engine 3 and distributed among the individual cylinders.

The exhaust gas produced by the combustion is ducted through the exhaust gas line 4 across the turbine side of the turbocharger 5. Since the turbine side is mechanically coupled, for example by a shaft, to the compressor side of the turbocharger 5, the turbine drives the compressor so that the air throughput is increased or the intake work of the pistons of the internal combustion engine 3 is decreased. The exhaust gas is discharged into the surroundings in the flow direction 7 after passing through the turbine side of the turbocharger 5 and the devices 6*a*, 6*b* for aftertreatment of the exhaust gas.

The exhaust gas line 4 and the intake line 8 are fluidically connected to each other across a device 19*a*, 19*a*' for exhaust gas recirculation, the device 19*a*, 19*a*' for exhaust gas recirculation being able to operate in the high pressure region and/or in the low pressure region.

The device 19*a*, 19*a*' for exhaust gas recirculation connects the exhaust gas line 4 in the flow direction 7 of the mass flow of exhaust gas upstream from the turbine side of the turbocharger 5 to the intake line 8 in the flow direction 9 of the intake mass air flow downstream from the charge air cooler 10 and thus downstream from the compressor side of the turbocharger 5 in the high pressure region as well as the exhaust gas line 4 in the flow direction 7 of the mass flow of exhaust gas downstream from the turbine side of the turbocharger 5 to the intake line 8 in the flow direction 9 of the intake mass air flow upstream from the compressor side of the turbocharger 5 in the low pressure region.

The device 19*a*, 19*a*' has the exhaust gas heat exchanger 11 for cooling the exhaust gas and for regulating the quantity and thus the dosage of the recirculated mass flow of the exhaust gas, a valve 14*a* configured inside the high pressure flow pathway SHD and a valve 14*b* configured inside the low pressure flow pathway SND.

The exhaust gas heat exchanger 11 in the embodiment of the device 19*a* of the system 1*a* per FIG. 2 is arranged between the flow pathways S1 and S2. The flow pathways S1 and S2 extend from one of the valves 14*a*, 14*b* of the high pressure flow pathway SHD and the low pressure flow pathway SND, respectively, to a mouth region.

Within each of the flow pathways S1 and S2 there is configured a valve 15, 16.

In the embodiment of the device 19*a*' of the system 1*b* per FIG. 3, unlike the embodiment per FIG. 2, the exhaust gas heat exchanger 11 is arranged inside the flow pathway S2 between the valve 16 and the mouth region. The high pressure flow pathway SHD and the low pressure flow pathway SND are merged together in the flow direction of the exhaust gas downstream from the valves 14*a*, 14*b* and travel as a common channel before the flow pathways S1, S2 branch off from the common channel.

Extending from the mouth region in the flow direction of the exhaust gas in both the system 1*a* of FIG. 2 and in the system 1*b* of FIG. 3 are two additional flow pathways S3, S4, while the flow pathway S3 as a component of the high pressure flow pathway SHD empties between the charge air cooler 10 and the internal combustion engine 3 and the flow pathway S4 as a component of the low pressure flow pathway SND empties upstream from the compressor side of the turbocharger 5 into the intake line 8. A valve 17, 18 is also configured in each case inside the flow pathways S3 and S4.

Figure 4:
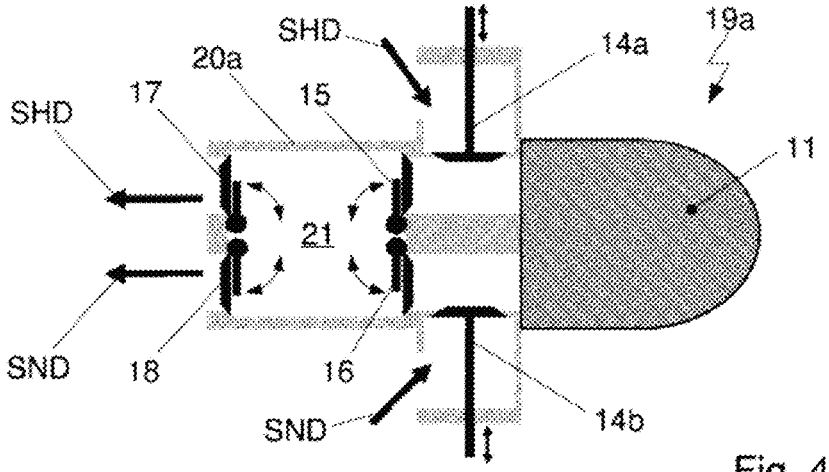
FIG. 4: Device for exhaust gas recirculation of a system per FIG. 2 with four flow pathways and valves arranged in the flow pathways, as well as an exhaust gas heat exchanger.

FIG. 4 shows a device 19*a* for exhaust gas recirculation of the system 1*a* per FIG. 2 with a housing 20*a*. In the housing 20*a* are integrated the valves 15, 16, 17, 18 arranged in the four flow pathways S1, S2, S3, S4, the valve 14*a* configured inside the high pressure flow pathway SHD and the valve 14*b* configured inside the low pressure flow pathway SND as well as the exhaust gas heat exchanger 11. The compact and one-piece/one-part or multiple-part housing 20*a* brings together all flow pathways S1, S2, S3, S4, the high pressure flow pathway SHD and the low pressure flow pathway SND and encompasses all the valves 14*a*, 14*b*, 15, 16, 17, 18.

The valves 14*a*, 14*b*, arranged as the inlet for the exhaust gas to the device 19*a*, are configured each as a seat valve or a poppet valve and can move back and forth in an indicated lengthwise direction. The exhaust gas flowing into the device 19*a* either through the high pressure flow pathway SHD or the low pressure flow pathway SND can as needed be taken through the exhaust gas heat exchanger 11 or bypassing the exhaust gas heat exchanger 11 into the mouth region 21.

The exhaust gas heat exchanger 11 is shown here as a U-flow heat exchanger, as an example.

The valves 15, 16, 17, 18 arranged in the four flow pathways S1, S2, S3, S4 are each configured as a flap valve and can move about a pivoting axis in an indicated direction of rotation. According to an alternative embodiment, not represented, the valves 15, 16, 17, 18 can be configured as seat valves. In the representation of FIG. 4, all the valves 14*a*, 14*b*, 15, 16, 17, 18 are closed.

The device 19*a* can be operated in the switching variants indicated in the following table. The flow pathways and the corresponding valves are designated with the reference symbols. The switch positions of the valves 14*a*, 14*b*, 15, 16, 17, 18 are indicated by "c" for closed and "o" for open.

| | Function | SHD 14a | SND 14b | S1 15 | S2 16 | S3 17 | S4 18 |
|---|---|---|---|---|---|---|---|
| I | Exhaust gas cooled to high pressure | o | c | c | o | o | c |
| II | Exhaust gas not cooled to high pressure | o | c | o | c | o | c |
| III | Exhaust gas cooled from high pressure to low pressure | o | c | c | o | c | o |
| IV | Exhaust gas not cooled from high pressure to low pressure | o | c | o | c | c | o |
| V | Exhaust gas cooled to low pressure | c | o | o | c | c | o |
| VI | Exhaust gas not cooled to low pressure | c | o | c | o | c | o |
| VII | Turbocharger 5 with air-divert/blow-off- function | c | c | — | — | o | o |
| VIII | Fresh air flow to the exhaust gas side | c | o | — | o | o | c |
| IX | Turbocharger 5 with bypass/waste gate function | o | o | — | — | c | c |
| X | Exhaust gas not cooled from low pressure and high pressure to low pressure | o | o | o | o | c | o |
| XI | Exhaust gas cooled from low pressure and high pressure to low pressure, exhaust gas cooled to high pressure | o | o | c | o | c | o |
| XII | Exhaust gas cooled from low pressure and high pressure to low pressure, exhaust gas cooled to high pressure, exhaust gas cooled to low pressure | o | o | o | c | c | o |
| XIII | Turbocharger 5 with divert-air/blow-off function and turbocharger 5 with bypass/waste gate function | o | o | c | c | o | o |

By Function I the device 19*a* is operated as an arrangement for recirculation of exhaust gas in the high pressure region with cooling of the exhaust gas. The exhaust gas is taken through the high pressure flow pathway SHD into the device 19*a*, through the exhaust gas heat exchanger 11 and the opened valve 16 into the mouth region 21 and taken away through the flow pathway S3 to the internal combustion engine 3.

By Function II the device 19*a* is operated as an arrangement for recirculation of exhaust gas in the high pressure region without cooling of the exhaust gas. The exhaust gas is taken through the high pressure flow pathway SHD into the device 19*a*, bypassing the exhaust gas heat exchanger 11, and through the opened valve 15 into the mouth region 21 and taken away through the flow pathway S3 to the internal combustion engine 3.

By Function III the device 19*a* is operated as an arrangement for removal of exhaust gas in the high pressure region with cooling of the exhaust gas and supplying of the exhaust gas in the low pressure region. The exhaust gas is taken through the high pressure flow pathway SHD into the device 19*a*, through the exhaust gas heat exchanger 11 and the opened valve 16 into the mouth region 21 and taken away through the flow pathway S4 to the compressor side of the turbocharger 5.

By Function IV the device 19*a* is operated as an arrangement for removal of exhaust gas in the high pressure region without cooling of the exhaust gas and supplying of the exhaust gas in the low pressure region. The exhaust gas is taken through the high pressure flow pathway SHD into the device 19*a*, bypassing the exhaust gas heat exchanger 11, and through the opened valve 15 into the mouth region 21 and taken away through the flow pathway S4 to the compressor side of the turbocharger 5.

By Function V the device 19*a* is operated as an arrangement for recirculation of exhaust gas in the low pressure region with cooling of the exhaust gas. The exhaust gas is taken through the low pressure flow pathway SND into the device 19*a*, through the exhaust gas heat exchanger 11 and the opened valve 15 into the mouth region 21 and taken away through the flow pathway S4 to the compressor side of the turbocharger 5.

By Function VI the device 19*a* is operated as an arrangement for recirculation of exhaust gas in the low pressure region without cooling of the exhaust gas. The exhaust gas is taken through the low pressure flow pathway SND into the device 19*a*, bypassing the exhaust gas heat exchanger 11, and through the opened valve 16 into the mouth region 21 and taken away through the flow pathway S4 to the compressor side of the turbocharger 5.

By Function VII the device 19*a* is operated only as a divert-air valve. The mass air flow taken in from the surroundings in the flow direction 9 bypasses the compressor side of the turbocharger 5 and the charge air cooler 10 and goes to the internal combustion engine 3. No exhaust gas is mixed in with the mass air flow taken in from the surroundings.

By Function VIII the device 19*a* is operated such that a fresh air flow is ducted to the exhaust gas side. The mass air flow taken in from the surroundings in the flow direction 9 is compressed upon flowing through the compressor side of the turbocharger 5 and taken across the charge air cooler 10 through the opened valve 17 into the device 19*a* and also through the opened valve 16 and the opened valve 14*b* bypassing the exhaust gas heat exchanger 11 to the device 6*b* for aftertreatment of the exhaust gas. Thus, the fresh air is taken in the flow direction 7 of the mass flow of exhaust gas upstream from the device 6*b*, in order to improve the aftertreatment of the exhaust gas, for example by further oxidation of unburned fuel. Function VIII can also be used as a device 6*b* for aftertreatment of the exhaust gas in the cold start phase of the internal combustion engine 3 for faster heat-up of a catalyst.

By Function IX the device 19*a* is operated only as a bypass or "waste gate" valve. The exhaust gas emerging in the flow direction 7 from the internal combustion engine 3 is taken past the turbine side of the turbocharger 5.

By Function X the device 19*a* is operated as an arrangement for removal of exhaust gas in the low pressure region and in the high pressure region without cooling of the exhaust gas and supplying of the exhaust gas in the low pressure region. Exhaust gas is taken both through the low pressure flow pathway SND and through the high pressure flow pathway SHD into the device 19*a*, bypassing the exhaust gas heat exchanger 11, and through the opened valve 15, 16 of the flow pathways S1, S2 into the mouth region 21 and taken away through the flow pathway S4 to the compressor side of the turbocharger 5. The valves 15, 16 can also be adjusted to achieve favorable pressure gradients for the ducting of the exhaust gas in regard to the distribution of the exhaust gas through the low pressure region and the high pressure region.

By Function XI the device 19*a* is operated as an arrangement for removal of exhaust gas in the low pressure region and in the high pressure region with cooling of the exhaust gas from the high pressure region and supplying of the exhaust gas in the low pressure region. Exhaust gas is taken into the device 19*a* through both the low pressure flow pathway SND and the high pressure flow pathway SHD. The exhaust gas taken in through the high pressure flow pathway SHD is taken through the exhaust gas heat exchanger 11, thereby cooled, and then mixed with the exhaust gas brought in through the low pressure flow pathway SND and taken through the opened valve 16 into the mouth region 21 and taken away through the flow pathway S4 to the compressor side of the turbocharger 5.

By Function XII the device 19*a* is operated as an arrangement for removal of exhaust gas in the low pressure region and in the high pressure region with cooling of the exhaust gas from the low pressure region and supplying of the exhaust gas in the low pressure region. Exhaust gas is taken both through the low pressure flow pathway SND and through the high pressure flow pathway SHD into the device 19*a*. The exhaust gas taken in through the low pressure flow pathway SND is taken through the exhaust gas heat exchanger 11, thereby cooled, and then mixed with the exhaust gas brought in through the high pressure flow pathway SHD and taken through the opened valve 15 into the mouth region 21 and taken away through the flow pathway S4 to the compressor side of the turbocharger 5.

By Function XIII the device 19*a* is operated as a divert-air valve and as a bypass or "waste gate" valve. On the one hand, the mass air flow taken in from the surroundings in the flow direction 9 is taken past the compressor side of the turbocharger 5 and the charge air cooler 10 to the internal combustion engine 3 and on the other hand the exhaust gas emerging in the flow direction 7 from the internal combustion engine 3 is taken past the turbine side of the turbocharger 5. No exhaust gas is mixed in with the mass air flow taken in from the surroundings.

Figure 5:
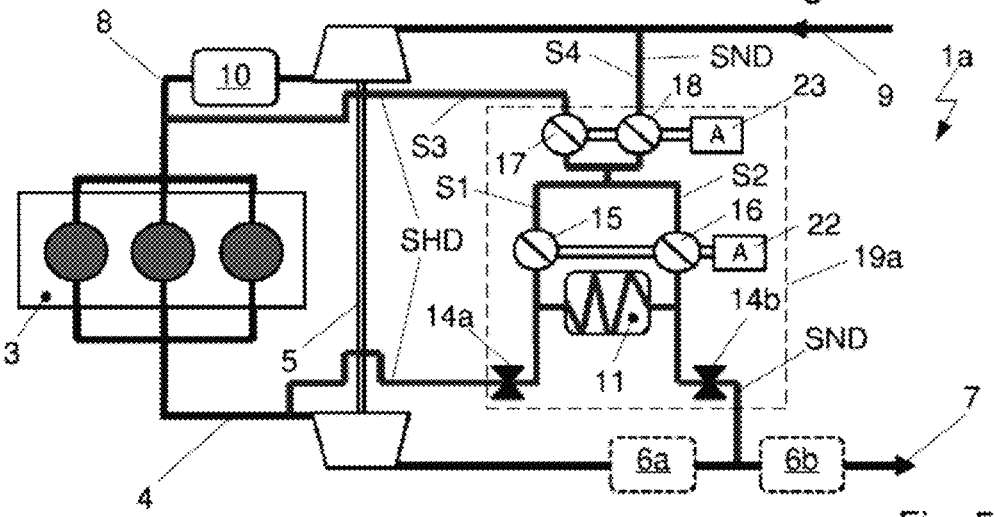
FIG. 5: System from FIG. 2 with common actuations of two valves each time, arranged in the flow pathways, each by means of an actuator.

FIG. 5 shows the system 1*a* for recirculation of exhaust gas of an internal combustion engine 3 from FIG. 2 with the device for exhaust gas recirculation 19*a* at high pressure or low pressure with the four flow pathways S1, S2, S3, S4 and the valves 15, 16, 17, 18 arranged therein, as well as the exhaust gas heat exchanger 11 with common actuations for every two valves 15, 16, 17, 18 arranged in the flow pathways S1, S2, S3, S4 each by means of an actuator 22, 23.

The valves 15 and 16 arranged inside the flow pathways S1 and S2 and the valves 17 and 18 arranged inside the flow pathways S3 and S4 are configured to be driven as so-called double valves each time with a single actuator 22, 23. The actuator 22 serves to control the valves 15, 16 and the actuator 23 serves to control the valves 17, 18.

The jointly moved valves 15 and 16 and the jointly moved valves 17 and 18 can take up any given position between open and closed independently of each other.

Figure 6:
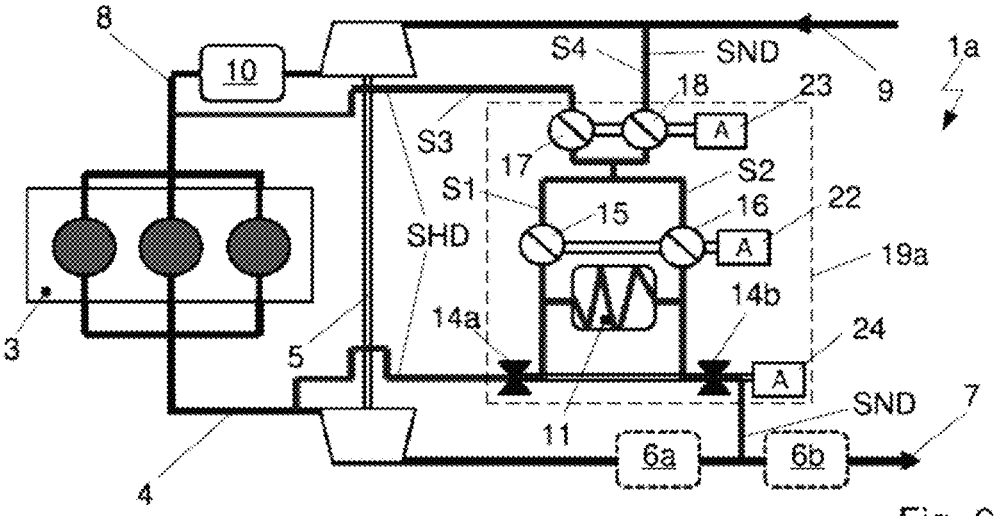
FIG. 6: System from FIG. 5 with common actuation of the valves configured inside the high pressure flow pathway SHD and the low pressure flow pathway SND by means of an actuator.

FIG. 6 shows the system 1*a* of FIG. 5 additionally with a common actuation of the valves 14*a*, 14*b* configured inside the high pressure flow pathway SHD and the low pressure flow pathway SND by means of an actuator 24.

The valves 14*a* and 14*b* are also configured to be driven as so-called double valves with the common actuator 24. The jointly moved valves 14*a* and 14*b* once again can take up any given position between open and closed independently of each other.

FIGS. 7A and 7B show an actuator 22, 23, 24 as a valve drive for the actuation of two valves with a drive 25 and two adjustment elements 26, 27 in a side view and in a top view.

The drive 25 can be configured with a gearing and is mechanically connected by a shaft to the adjustment elements 26, 27, so that a turning of the shaft produces a turning of the adjustment elements 26, 27.

The adjustment elements 26, 27 have a round or rounded shape and are arranged eccentrically to the shaft, spaced away from the shaft in the lengthwise direction and also rotated relative to each other about the axis of the shaft.

FIG. 7C shows the actuator per FIG. 7B with the two adjustment elements 26, 27 each connected to a valve 14*a*, 15, 17 and 14*b*, 16, 18. Thanks to the arrangement of the adjustment elements 26, 27 rotated differently about the axis of the shaft and eccentrically to the shaft, the disks of the valves 14*a*, 15, 17 and 14*b*, 16, 18 are lifted and lowered differently and thus the valves 14*a*, 15, 17 and 14*b*, 16, 18 are opened and closed differently.

Figure 7D:
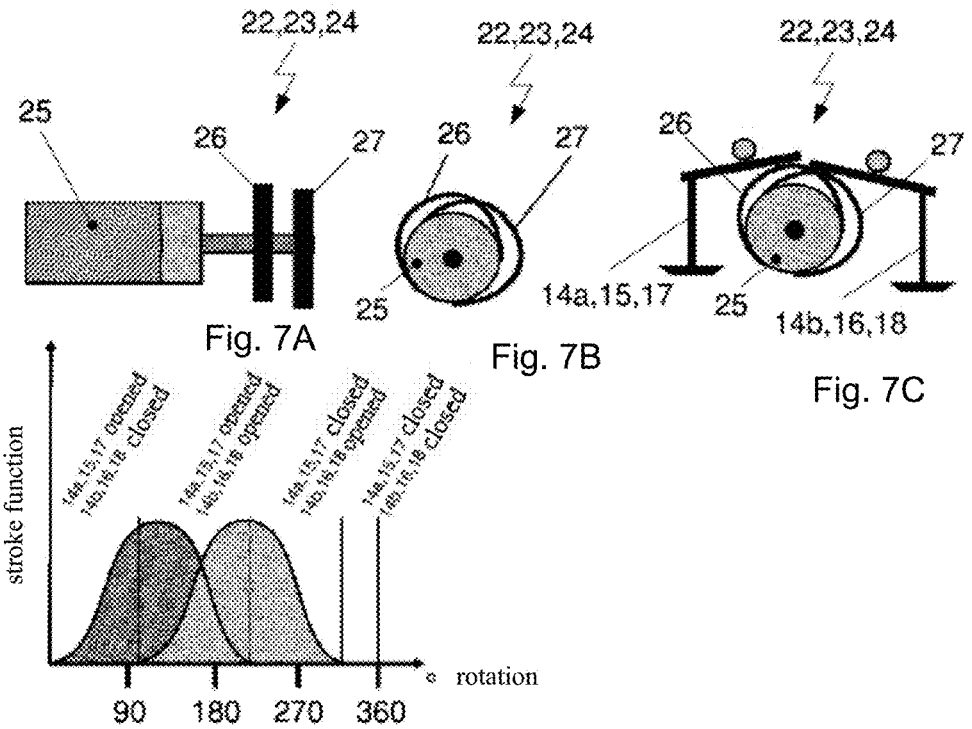
FIG. 7D: Representation of the stroke function of the actuator for control of the valves with the opening degree of the valves dependent on the angle of rotation of the adjustment elements.

FIG. 7D shows the stroke function of the actuators 22, 23, 24 for the control of the valves 14*a*, 15, 17 and 14*b*, 16, 18 with the degree of opening of the valves 14*a*, 15, 17 and 14*b*, 16, 18 depending on the angle of rotation of the adjustment elements 26, 27. The adjustment elements 26, 27 have external shapes or contours fashioned in the radial direction with which the following stroke functions can be executed upon rotation of the adjustment elements 26, 27.

Upon rotation of the shaft and thus the adjustment elements 26, 27 in the range from 0°, the valve 14*a*, 15, 17 is activated to open, while the valve 14*b*, 16, 18 remains closed.

Upon rotation of the shaft in the range between around 100° and around 215°, the valve 14*a*, 15, 17 is activated to close, while the valve 14*b*, 16, 18 is activated to open. In an intermediate range from 100° to 215° with the valve 14*a*, 15, 17 and the valve 14*b*, 16, 18 both valves are at least partly opened.

Upon rotation of the shaft in the range between around 215° and around 320°, the valve 14*b*, 16, 18 is activated to close, while the valve 14*a*, 15, 17 remains closed. In the range from 320° to 360° or 0° both valves 14*a*, 15, 17 and 14*b*, 16, 18 are closed.

Besides the design of the actuators per FIG. 7A to 7C, other systems are also conceivable, such as linear, electrical or hydraulic ones. The systems can be used for only one or two or three valve pairs.

Figure 8:
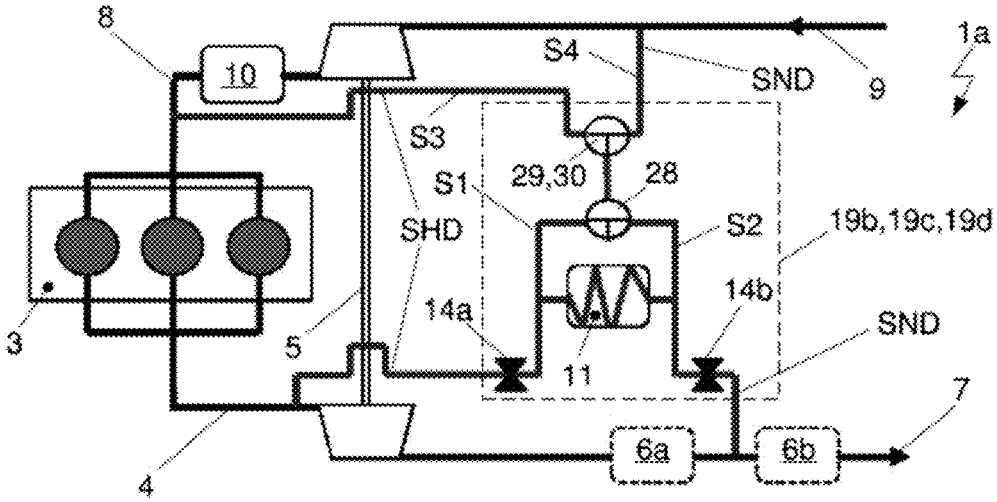
FIG. 8: System from FIG. 2 with a device for exhaust gas recirculation each time with a three-way valve instead of two valves arranged in the flow pathways.

FIG. 8 shows the system 1*a* from FIG. 2 with a device 19*b*, 19*c*, 19*d* for exhaust gas recirculation each time with a three-way valve 28, 29, 30 instead of the two valves 15, 16, 17, 18 arranged in the flow pathways S1, S2, S3, S4. The first three-way valve 28 replaces the valves 15, 16 from the flow pathways S1, S2, while the second three-way valve 29, 30 replaces the valves 17, 18 from the flow pathways S3, S4.

Figure 9:
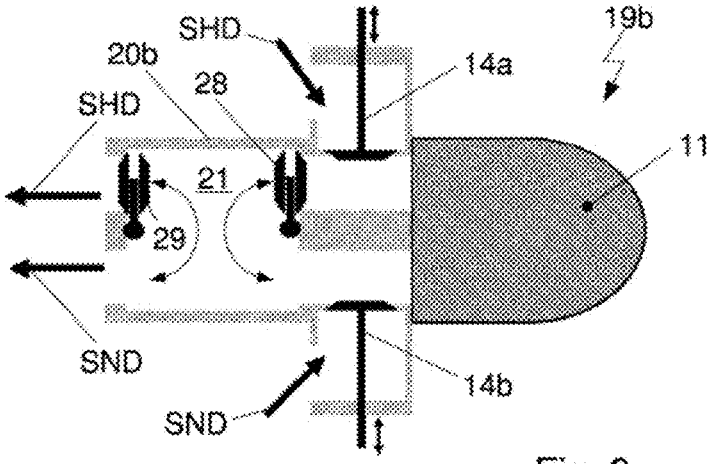
FIGS. 9, 10: Device for exhaust gas recirculation of a system per FIG. 8 with four flow pathways and two three-way valves arranged in the flow pathways as flap valves as well as the exhaust gas heat exchanger.
Figure 10:
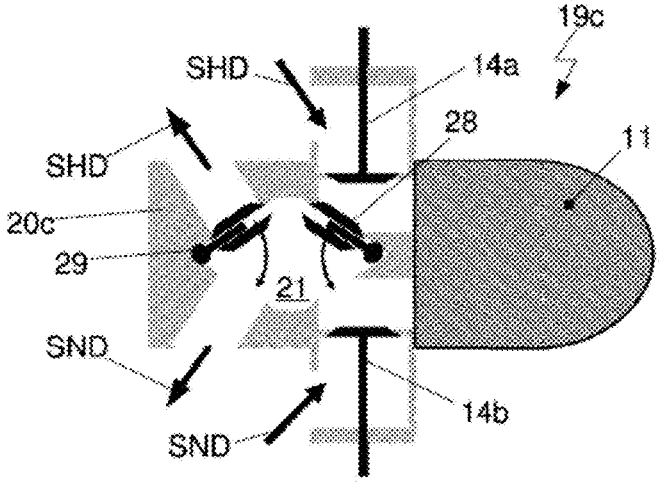
Figure 11:
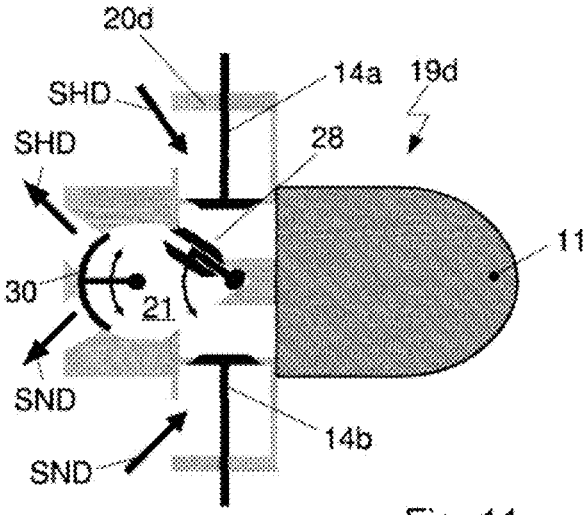
FIG. 11: Device for exhaust gas recirculation of a system per FIG. 8 with four flow pathways and two three-way valves arranged in the flow pathways, the first three-way valve being configured as a flap valve and the second three-way valve as a rotary valve, as well as the exhaust gas heat exchanger.

The embodiments of a device 19*b*, 19*c*, 19*d* of the system 1*a* per FIG. 8 are shown in FIGS. 9 to 11. Due to the configuration of the three-way valves 28, 29, the possible functions which require each time two closed flow pathways S1 and S2 or S3 and S4 are limited as compared to the configuration of the device 19*a* per FIG. 4.

FIGS. 9 and 10 show devices 19*b*, 19*c* for exhaust gas recirculation of system 1*a* per FIG. 8 each time with a housing 20*b*, 20*c*. The housings 20*b*, 20*c* integrate the three-way valves 28, 29 arranged in the four flow pathways S1, S2, S3, S4 and configured as flap valves, the valve 14*a* configured inside the high pressure flow pathway SHD and the valve 14*b* configured inside the low pressure flow pathway SND as well as the exhaust gas heat exchanger 11.

The compact and single-piece/single-part or multiple-part housings 20*b*, 20*c* bring together all flow pathways S1, S2, S3, S4, the high pressure flow pathway SHD and the low pressure flow pathway SND, and encompass all valves 14*a*, 14*b*, 28, 29.

The valves 14*a*, 14*b* arranged as the inlet of the exhaust gas into the device 19*b*, 19*c* are once again each configured as a seat valve or a poppet valve and can move back and forth in the indicated lengthwise direction. The exhaust gas flowing into the device 19*b*, 19*c* either through the high pressure flow pathway SHD or the low pressure flow pathway SND can be taken as needed through the exhaust gas heat exchanger 11 or bypassing the exhaust gas heat exchanger 11 into the mouth region 21.

The exhaust gas heat exchanger 11 once again is configured as a U-flow heat exchanger as an example.

The three-way valves 28, 29 arranged in the four flow pathways S1, S2, S3, S4 can move about an axis of rotation in a direction indicated each time. In the representations of FIGS. 9 and 10, the valves 14*a* and 14*b* as well as the flow pathways S1 and S3 are closed.

The three-way valves 28, 29 of the device 19*b* per FIG. 9 and in the device 19*c* per FIG. 10 are able to flip between two end positions, the axes of rotation being arranged each time at the edge of the mouth region 21 and between the two mouths of the flow pathways S1, S2 or S3, S4 into the mouth region 21.

The devices 19*b*, 19*c* can also be operated basically in the switching variants listed in the table given above for the device 19*a* for exhaust gas recirculation per FIG. 4. However, the devices 19*b*, 19*c* cannot be operated with the functions IX and XIII, since in functions IX and XIII the two flow pathways S1 and S2 or S3 and S4 are closed each time, which cannot be accomplished with the three-way valves 28, 29.

FIG. 11 shows a device 19*d* for exhaust gas recirculation of the system 1*a* per FIG. 8 with a housing 20*d*. In the housing 20*d* are integrated the three-way valve 28 arranged in the two flow pathways S1, S2 and configured as a flap valve, the three-way valve 30 arranged in the two flow pathways S3, S4 and configured as a rotary valve, the valve 14*a* configured inside the high pressure flow pathway SHD and the valve 14*b* configured inside the low pressure flow pathway SND, as well as the exhaust gas heat exchanger 11. The compact and single-piece/single-part or multiple-part housing 20*d* brings together all flow pathways S1, S2, S3, S4, the high pressure flow pathway SHD and the low pressure flow pathway SND, and encompasses all valves 14*a*, 14*b*, 28, 30.

The valves 14*a*, 14*b* arranged as the inlet of the exhaust gas into the device 19*d* are, as in the previously mentioned embodiments, each configured as a seat valve or a poppet valve and can move back and forth in the indicated lengthwise direction. The exhaust gas flowing into the device 19*d* either through the high pressure flow pathway SHD or the low pressure flow pathway SND can be taken as needed through the exhaust gas heat exchanger 11 or bypassing the exhaust gas heat exchanger 11 into the mouth region 21.

The exhaust gas heat exchanger 11, as in the previously mentioned embodiments, is configured as a U-flow heat exchanger as an example.

The three-way valves 28, 30 arranged in the four flow pathways S1, S2, S3, S4 can move about an axis of rotation in a direction indicated each time. In the representations of FIG. 11, the valves 14*a* and 14*b* as well as the flow pathways S1, S3 and S4 are closed.

The three-way valve 28 is able to flip between two end positions, the axis of rotation being arranged within the mouth region 21 and between the two emptying points of the flow pathways S1, S2 into the mouth region 21. The three-way valve 30 is able to turn between two end positions, the axis of rotation being arranged within the mouth region 21, preferably symmetrically to the two end positions of the flow pathways S3, S4.

The device 19*d* can also be operated basically in the switching variants listed in the table given above for the device 19*a* for exhaust gas recirculation per FIG. 4. However, the device 19*d* cannot be operated with the function XIII, since in function XIII the two flow pathways S1 and S2 are closed, which is not possible with the three-way valve 28.

Figure 12:
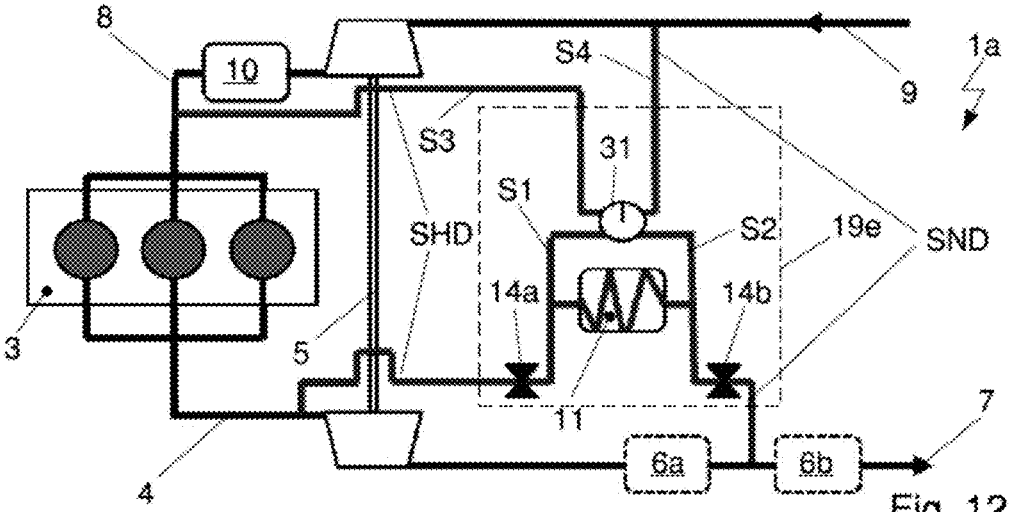
FIG. 12: System from FIG. 2 with a device for exhaust gas recirculation with a four-way valve instead of four individual valves arranged in the flow pathways.

FIG. 12 shows the system 1*a* from FIG. 2 with a device 19*e* for exhaust gas recirculation with a four-way valve 31 instead of the four valves 15, 16, 17, 18 arranged in the flow pathways S1, S2, S3, S4. The four-way valve 31 is this arranged between the flow pathways S1, S2, S3, S4.

Figure 13:
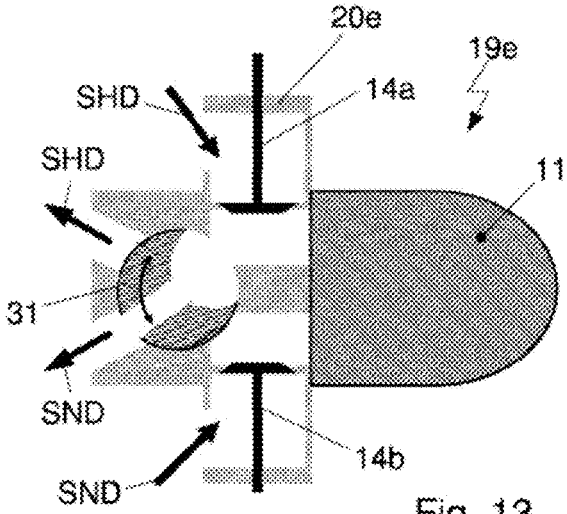
FIG. 13: Device for exhaust gas recirculation of a system per FIG. 12 with four flow pathways and a four-way valve configured as a rotary valve arranged between the flow pathways.

FIG. 13 shows a device 19*e* for exhaust gas recirculation of the system 1*a* per FIG. 12 with a housing 20*e*. In the housing 20*e* are integrated the four-way valve 31 arranged between the flow pathways S1, S2, S3, S4 and configured as a central rotary valve, the valve 14*a* configured within the high pressure flow pathway SHD and the valve 14*b* configured within the low pressure flow pathway SND, as well as the exhaust gas heat exchanger 11. The compact and single-piece/single-part or multiple-part housing 20*e* brings together all flow pathways S1, S2, S3, S4, the high pressure flow pathway SHD and the low pressure flow pathway SND, and encompasses all valves 14*a*, 14*b*, 31.

The valves 14*a*, 14*b* arranged as the inlet of the exhaust gas into the device 19*e* are, as in the previously mentioned embodiments, each configured as a seat valve or a poppet valve and can move back and forth in the lengthwise direction. The exhaust gas flowing into the device 19*e* either through the high pressure flow pathway SHD or the low pressure flow pathway SND can be taken as needed through the exhaust gas heat exchanger 11 or bypassing the exhaust gas heat exchanger 11.

The exhaust gas heat exchanger 11, as in the previously mentioned embodiments, is configured as a U-flow heat exchanger as an example.

The four-way valve 31 arranged between the four flow pathways S1, S2, S3, S4 can move about an axis of rotation in the indicated directions. In the representation of FIG. 13, the valves 14*a* and 14*b* as well as the flow pathways S2 and S3 are closed. The flow pathways S1 and S4 are opened.

The four-way valve 31 is configured with an adjustment element which is round in cross section and able to turn about the axis of rotation. The adjustment element has a through opening, which extends from a first end with a uniform cross section and has a cross section widening toward the second end. The cross section of the through opening can also widen continuously from the first end to the second end.

The cross sections at the ends of the continuous opening correspond to the embodiments of the flow pathways S1, S2, S3, S4 within the housing 20*e*, that is, to the arrangements and cross sections of the flow pathways S1, S2, S3, S4 in the region of the adjustment element, such that the flow pathways S1, S2, S3, S4 can be opened or closed according to the functions listed in the above given table.

Thus, the device 19*e* can be operated in all of the switching variants listed in the table indicated above for the device 19*a* for exhaust gas recirculation per FIG. 4.

Figure 14:
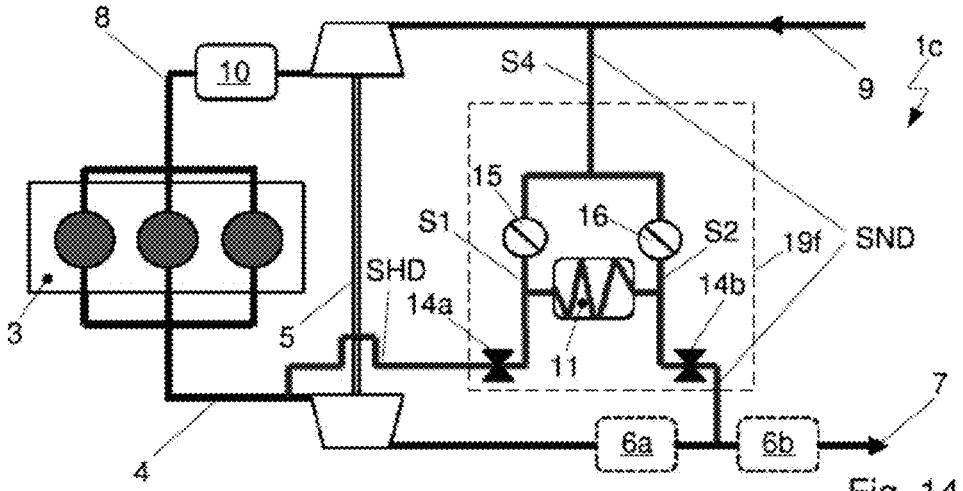
FIGS. 14, 15: System for recirculation of exhaust gas of an internal combustion engine with a device for exhaust gas recirculation from high pressure or low pressure to low pressure with three flow pathways and valves arranged in two flow pathways as well as an exhaust gas heat exchanger.
Figure 15:
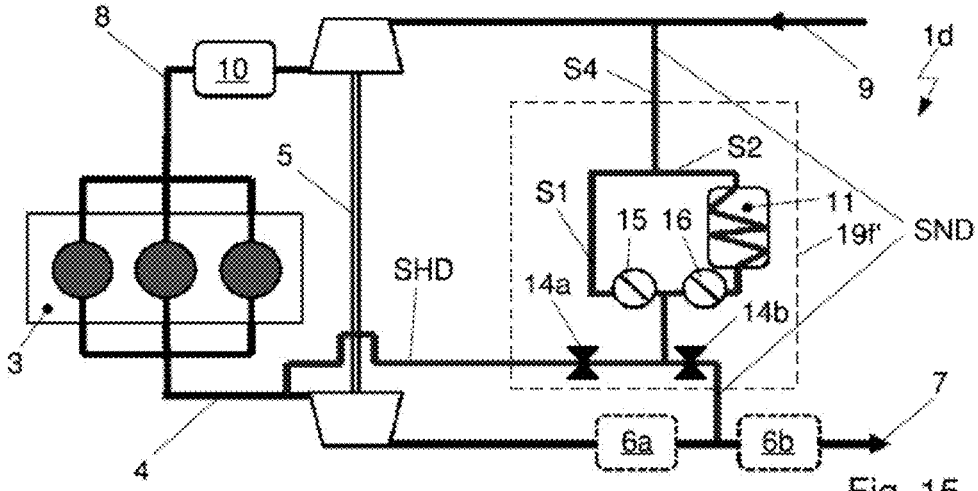

FIGS. 14 and 15 show systems 1*c*, 1*d* for recirculation of exhaust gas of an internal combustion engine 3 with a device 19*f*, 19*f'* for exhaust gas recirculation from high pressure or low pressure to low pressure with three flow pathways S1, S2, S4 and valves 15, 16 arranged in the two flow pathways S1, S2 as well as an exhaust gas heat exchanger 11.

The exhaust gas line 4 and the intake line 8 are fluidically joined together via the device 19*f*, 19*f'* for exhaust gas recirculation, the device 19*f*, 19*f'* for exhaust gas recirculation being able to receive exhaust gas from the high pressure region and/or the low pressure region and the exhaust gas is taken to the fresh air in the low pressure region. As compared to the embodiments per FIGS. 2 and 3, the devices 19*f*, 19*f'* have no flow pathway S3 as a connection to the high pressure side of the intake region between the compressor side of the turbocharger 5 and the internal combustion engine 3. Thus, the valves 17, 18 of the flow pathways S3, S4 are also eliminated.

The device 19*f*, 19*f'* for exhaust gas recirculation connects the exhaust gas line 4 in the flow direction 7 of the mass flow of exhaust gas upstream from the turbine side of the turbocharger 5 and downstream from the turbine side of the turbocharger 5 in the high pressure region to the intake line 8 in the flow direction 9 of the intake mass air flow upstream from the compressor side of the turbocharger 5 in the low pressure region.

The device 19*f*, 19*f'* has the exhaust gas heat exchanger 11 for cooling the exhaust gas and for regulating the quantity and thus the dosage of the recirculated mass flow of exhaust gas, a valve 14*a* configured inside the high pressure flow pathway SHD, and a valve 14*b* configured inside the low pressure flow pathway SND.

The exhaust gas heat exchanger 11 in the embodiment of the device 19*f* of system 1*c* per FIG. 14 is arranged between the flow pathways S1 and S2. The flow pathways S1 and S2 extend each from one of the valves 14*a*, 14*b* of the high pressure flow pathway SHD or the low pressure flow pathway SND up to a mouth region. Each time a valve 15, 16 is configured within the flow pathways S1 and S2.

In the embodiment of the device 19*f'* of the system 1*d* per FIG. 15, unlike the embodiment per FIG. 14, the exhaust gas heat exchanger 11 is arranged inside the flow pathway S2 between the valve 16 and the mouth region. The high pressure flow pathway SHD and the low pressure flow pathway SND are brought together in the flow direction of the exhaust gas downstream from the valves 14*a*, 14*b* and run as a common channel before the flow pathways S1, S2 branch off from the common channel.

In each case a flow pathway S4 extends from the mouth region in the flow direction of the exhaust gas both in the system 1*c* from FIG. 14 and in the system 1*d* from FIG. 15, with the flow pathway S4 as a component of the low pressure flow pathway SND emptying into the intake line 8 upstream from the compressor side of the turbocharger 5.

Figure 16:
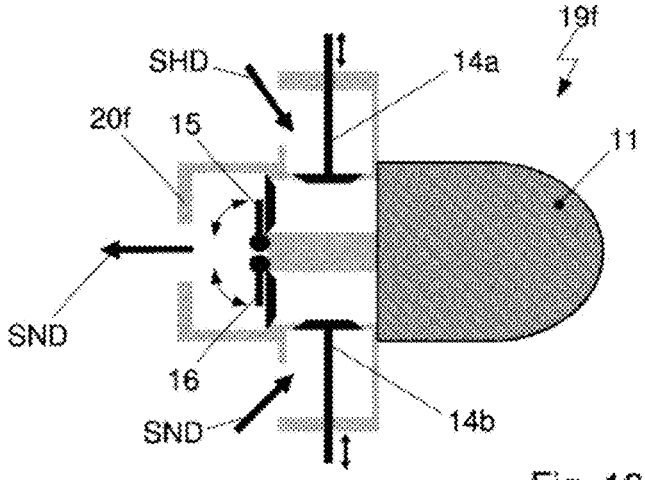
FIG. 16: Device for exhaust gas recirculation of a system per FIG. 14 with flow pathways and valves arranged in flow pathways as well as an exhaust gas heat exchanger.

FIG. 16 shows a device 19*f* for exhaust gas recirculation of the system 1*c* per FIG. 14 with a housing 20*f*. In the housing 20*f* are integrated the valves 15, 16 arranged in the flow pathways S1, S2, the valve 14*a* configured inside the high pressure flow pathway SHD and the valve 14*b* configured inside the low pressure flow pathway SND as well as the exhaust gas heat exchanger 11. The compact and single-piece/single-part or multiple-part housing 20*f* brings together all flow pathways S1, S2, S4, the high pressure flow pathway SHD and the low pressure flow pathway SND, and encompasses all valves 14*a*, 14*b*, 15, 16.

The valves 14*a*, 14*b* arranged as the inlet of the exhaust gas into the device 19*f* are each configured as a seat valve or a poppet valve and can move back and forth in an indicated lengthwise direction. The exhaust gas flowing into the device 19*f* either through the high pressure flow pathway SHD or the low pressure flow pathway SND can be taken as needed through the exhaust gas heat exchanger 11 or bypassing the exhaust gas heat exchanger 11.

The exhaust gas heat exchanger 11, as in the previously mentioned embodiments, is configured as a U-flow heat exchanger as an example.

Regardless of the different embodiments, the valve 14*a* of the high pressure flow pathway SHD and the valve 14*b* of the low pressure flow pathway SND can be configured with an actuator 24 for simultaneous and joint actuation.

The valves 15, 16 arranged in the flow pathways S1, S2 are configured each time as a flap valve and can move about an axis of rotation in an indicated direction. According to an alternative embodiment, not shown, the valves 15, 16 are configured as a seat valve or poppet valve. In the representation of FIG. 16, all valves 14*a*, 14*b*, 15, 16 are closed.

Only the functions I, II, VII and XIII of the embodiment of the device 19*a* per FIG. 4 as listed in the above given table cannot be implemented with the device 19*f* per FIG. 14, primarily because the flow pathway S3 is not configured as a connection of the device 19*f* to the high pressure region.

LIST OF REFERENCE SYMBOLS

1*a*, 1*b*, 1*c*, 1*d*, 1' System for air ducting
2*a'* Arrangement for exhaust gas recirculation, high pressure
2*b'* Arrangement for exhaust gas recirculation, low pressure
3 Internal combustion engine
4 Exhaust gas line
5 Turbocharger
6*a*, 6*b* Device for aftertreatment of exhaust gas
7 Flow direction of exhaust gas mass flow
8 Intake line
9 Flow direction of intake mass air flow
10 Charge air cooler
11, 11*a'*, 11*b'* Exhaust gas heat exchanger
12*a'*, 12*b'* Bypass
13*a'*, 13*b'* Bypass valve
14*a*, 14*a'* Valve high pressure
14*b*, 14*b'* Valve low pressure
15 Valve flow pathway S1
16 Valve flow pathway S2
17 Valve flow pathway S3
18 Valve flow pathway S4
19*a*, 19*a'*, 19*b*, 19*c* Device for exhaust gas recirculation
19*d*, 19*e*, 19*f*, 19*f'* Device for exhaust gas recirculation
20*a*, 20*b*, 20*c* Housing
20*d*, 20*e*, 20*f* Housing
21 Mouth region
22, 23, 24 Actuator
25 Drive
26, 27 Adjustment element
28, 29 Three-way valve
30 Three-way valve
31 Four-way valve
S1, S2, S3, S4 Flow pathways
SHD High pressure flow pathway
SND Low pressure flow pathway

What is claimed is:

1. An air ducting device for air ducting of an internal combustion engine in a motor vehicle having a turbocharger arranged between an exhaust gas line for the expansion of exhaust gas exiting the internal combustion engine and an intake line for compression of intake air to be delivered to the internal combustion engine, the air ducting device comprising:

a housing;

a high pressure flow pathway with a first valve, the high pressure flow pathway branching the intake line downstream from a compressor side of the turbocharger in a flow direction of the intake air to the exhaust gas line between the internal combustion engine and upstream from a turbine side of the turbocharger in a flow direction of the exhaust gas;

a low pressure flow pathway with a second valve, the low pressure flow pathway branching from the exhaust gas line downstream from the turbine side of the turbocharger in the flow direction of the exhaust gas to the intake line upstream of the compressor side of the turbocharger in the flow direction of the intake air;

a first flow pathway of the low pressure flow pathway branching the intake line upstream of the compressor side of the turbocharger in the flow direction of the intake air to a mouth region of the first flow pathway;

a second flow pathway of the high pressure flow pathway having a third valve and extending from the first valve to the mouth region of the first flow pathway;

a third flow pathway of the low pressure flow pathway having a fourth valve and extending from the second valve to the mouth region of the first flow pathway, the second flow pathway and the third flow pathway merging in the mouth region of the first flow pathway; and an exhaust gas heat exchanger, wherein at least a portion of each of the high pressure flow pathway, the low pressure flow pathway, the first flow pathway, the second flow pathway, the third flow pathway, and the exhaust gas heat exchanger is integrated within the housing.

2. The air ducting device according to claim 1, wherein a portion of the housing is formed as a continuous one-piece component.

3. The air ducting device according to claim 2, wherein at least one of the first valve, the second valve, the third valve, and the fourth valve is integrated within the housing.

4. The air ducting device according to claim 1, wherein the exhaust gas heat exchanger is arranged between and fluidly couples the second flow pathway to the third flow pathway.

5. The air ducting device according to Claim 1, wherein the exhaust gas heat exchanger is arranged between and fluidly couples the high pressure flow pathway to the low pressure flow pathway.

6. The air ducting device according to claim 1, wherein the high pressure flow pathway and the low pressure flow pathway merge at a merge region and each of the second flow pathway and the third flow pathway extends away from the merge region, and wherein the exhaust gas heat exchanger is arranged in the third flow pathway.

7. The air ducting device according to claim 1, wherein a fourth flow pathway branches from the intake line downstream from the compressor side of the turbocharger in the direction of flow of the intake air and extends to the mouth region of the first flow pathway, the fourth flow pathway including a fifth valve and the first flow pathway including a sixth valve.

8. The air ducting device according to claim 7, wherein each of the fifth valve and the sixth valve is integrated within the housing.

9. The air ducting device according to claim 1, wherein the first valve and the second valve are configured for simultaneous and joint actuation by a first actuator.

10. The air ducting device according to claim 9, wherein the third valve and the fourth valve are configured for simultaneous and joint actuation by a second actuator.

11. A method of operating a system for air ducting of an internal combustion engine in a motor vehicle, the system comprising a turbocharger arranged between an exhaust gas line for the expansion of exhaust gas exiting the internal combustion engine and an intake line for compression of intake air to be delivered to the internal combustion engine; the method comprising the steps of:

providing an air ducting device comprising:

a housing, a high pressure flow pathway with a first valve, the high pressure flow pathway branching from the exhaust gas line downstream from the internal combustion engine and upstream from a turbine side of the turbocharger in a flow direction of the exhaust gas to the intake line downstream from a compressor side of the turbocharger and upstream from the internal combustion engine in a flow direction of the intake air;

a low pressure flow pathway with a second valve, the low pressure flow pathway branching from the exhaust gas line downstream from the turbine side of the turbocharger in the flow direction of the exhaust gas to the intake line upstream from the compressor side of the turbocharger in the flow direction of the intake air;

a first flow pathway of the low pressure flow pathway having a third valve and branching from the intake line upstream of the compressor side of the turbocharger in the flow direction of the intake air to a mouth region of the first flow pathway;

a second flow pathway of the high pressure flow pathway having a fourth valve and a third flow pathway of the low pressure flow pathway having a fifth valve, the second flow pathway extending from the first valve to the mouth region of the first flow pathway, the third flow pathway extending from the second valve to the mouth region of the first flow pathway, the second flow pathway and the third flow pathway merging together in the mouth region of the first flow pathway;

a fourth flow pathway having a sixth valve and branching from the intake line downstream from the compressor side of the turbocharger in the direction of flow of the intake air and extending to the mouth region of the first flow pathway;

an exhaust gas heat exchanger, wherein at least a portion of each of the high pressure flow pathway, the low pressure flow pathway, the first flow pathway, the second flow pathway, the third flow pathway, the fourth flow pathway, and the exhaust gas heat exchanger is integrated within the housing; and adjusting at least one of the first valve, the second valve, the third valve, the fourth valve, the fifth valve, and the sixth valve between an open position and a closed position to change an operational mode of the air ducting device.

12. The method according to claim 11, wherein the exhaust gas line includes an exhaust high pressure region extending from the internal combustion engine to the turbine side of the turbocharger and an exhaust low pressure region formed downstream from the turbine side of the turbocharger in the direction of flow of the exhaust gas and the intake line includes an intake high pressure region extending from the compressor side of the turbocharger to the internal combustion engine and an intake low pressure region formed upstream from the compressor side of the turbocharger in the direction of flow of the intake air.

13. The method according to claim 12, wherein the air ducting device is configured to be operational in each of the following operational modes:

removal of the exhaust gas from the exhaust high pressure region and supplying of the exhaust gas to the intake low pressure region with cooling of the exhaust gas by the exhaust gas heat exchanger during a first operational mode;

removal of the exhaust gas from the exhaust high pressure region and supplying of the exhaust gas to the intake low pressure region without cooling of the exhaust gas by the exhaust gas heat exchanger during a second operational mode;

removal of the exhaust gas from the exhaust low pressure region and supplying of the exhaust gas to the intake low pressure region with cooling of the exhaust gas by the exhaust gas heat exchanger during a third operation mode; and removal of the exhaust gas from the exhaust low pressure region and supplying of the exhaust gas to the intake low pressure region without cooling of the exhaust gas by the exhaust gas heat exchanger during a fourth operational mode.

14. The method according to claim 13, wherein the air ducting device is further configured to be operational in each of the following operational modes:

removal of the exhaust gas from the exhaust low pressure region and supplying of the exhaust gas to the intake high pressure region without cooling of the exhaust gas by the exhaust gas heat exchanger during a fifth operational mode;

removal of the exhaust gas from both the exhaust high pressure region and the exhaust low pressure region and supplying of the exhaust gas to the intake low pressure region without cooling of the exhaust gas by the exhaust gas heat exchanger during a sixth operational mode;

removal of the exhaust gas from both the exhaust high pressure region and the exhaust low pressure region and supplying of the exhaust gas to the intake low pressure region with cooling of the exhaust gas removed from the exhaust high pressure region by the exhaust gas heat exchanger during a seventh operational mode; and removal of the exhaust gas from both the exhaust high pressure region and the exhaust low pressure region and supplying of the exhaust gas to the intake low pressure region with cooling of the exhaust gas removed from the exhaust low pressure region by the exhaust gas heat exchanger during an eighth operational mode.

15. The method according to claim 12, wherein the air ducting device is configured to be operational in each of the following operational modes:

removal of the exhaust gas from the exhaust high pressure region and supplying of the exhaust gas to the intake high pressure region with cooling of the exhaust gas by the exhaust gas heat exchanger during a first operational mode;

removal of the exhaust gas from the exhaust high pressure region and supplying of the exhaust gas to the intake high pressure region without cooling of the exhaust gas by the exhaust gas heat exchanger during a second operational mode; and removal of the intake air from the intake low pressure region and supplying of the intake air to the intake high pressure region during a third operational mode.

16. The method according to claim 12, wherein the air ducting device is configured to be operational in a waste-gate operational mode wherein the exhaust gas is removed from the exhaust high pressure region and supplied to the exhaust low pressure region to bypass the turbine side of the turbocharger.

17. The method according to claim 16, wherein the waste-gate operational mode includes the first valve and the second valve each being adjusted to the open position and the third valve and the sixth valve each being adjusted to the closed position.

* * * * *